US011311458B2

(12) United States Patent
Panick et al.

(10) Patent No.: US 11,311,458 B2
(45) Date of Patent: Apr. 26, 2022

(54) BINARY CONNECTOR FOR DRUG RECONSTITUTION

(71) Applicants: Nick Panick, Bethlehem, PA (US); Bruce Brunetti, Phillipsburg, NJ (US); Michael Janders, Northampton, PA (US); Alan Wentzell, Easton, PA (US)

(72) Inventors: Nick Panick, Bethlehem, PA (US); Bruce Brunetti, Phillipsburg, NJ (US); Michael Janders, Northampton, PA (US); Alan Wentzell, Easton, PA (US)

(73) Assignee: B Braun Medical Inc., Bethlehem, PA (US)

( * ) Notice: Subject to any disclaimer, the term of this patent is extended or adjusted under 35 U.S.C. 154(b) by 295 days.

(21) Appl. No.: 16/567,568

(22) Filed: Sep. 11, 2019

(65) Prior Publication Data

US 2021/0069063 A1 Mar. 11, 2021

(51) Int. Cl.
*A61J 1/20* (2006.01)
*A61J 1/14* (2006.01)

(52) U.S. Cl.
CPC ..... *A61J 1/2089* (2013.01); *A61J 1/1412* (2013.01); *A61J 1/201* (2015.05); *A61J 1/2055* (2015.05)

(58) Field of Classification Search
CPC ..... A61J 1/2089; A61J 1/201; A61J 1/2055; A61J 1/1412; A61J 1/20–2096; A61J 1/2013; A61J 1/2058; A61J 1/2037; A61J 1/1406; F16K 5/02; F16K 5/0207; F16K 5/0214; F16K 5/0221; F16K 5/0228; F16K 5/0235; F16K 5/0242; F16K 5/025; F16K 5/0257; F16K 5/0264; F16K 5/0271; F16K 5/0278; F16K 5/0285; F16K 5/0292; F16K 5/04; F16K 5/0407; F16K 5/0414; F16K 5/0421; F16K 5/0428; F16K 5/0435; F16K 5/0442; F16K 5/045; F16K 5/0457; F16K 5/0464; F16K 5/0471; F16K 5/0478; F16K 5/0485; F16K 5/0492; F16K 27/065;
(Continued)

(56) References Cited

U.S. PATENT DOCUMENTS 1,717,025 A 6/1929 Green
2,210,335 A 1/1939 Mueller
(Continued)

FOREIGN PATENT DOCUMENTS

CN 105616159 A * 6/2016
WO WO-2014177347 A1 * 11/2014 ..... A61J 1/2089

*Primary Examiner* — Quang D Thanh
*Assistant Examiner* — Brandon W. Levy

(57) ABSTRACT

A connector is configured to connect a drug container with a solution container and permit contents of the drug container to be combined with the solution container. The connector has a connector body with a first coupling for fluid connection with the drug container. The first coupling defines a first fluid passage. The connector body also has a second coupling for fluid connection with the solution container. The second coupling defines a second fluid passage. A control valve has a movable valve body that defines a third fluid passage. The valve body is positionable relative to the connector body in a first position, in which the first fluid passage is sealed from the second fluid passage. The valve body is also positionable in a second position, in which the first fluid passage is connected in fluid communication with the second fluid passage by the third fluid passage.

26 Claims, 9 Drawing Sheets

(58) Field of Classification Search
CPC ... F16K 27/062; A61M 39/223; A61M 5/162; A61M 2039/229; A61M 2207/00; Y10T 137/86823; Y10T 137/86863; Y10T 137/86871; Y10T 137/71
See application file for complete search history.

(56) References Cited

U.S. PATENT DOCUMENTS

| | | | | |
|---|---|---|---|---|
| 2,781,787 | A | 2/1957 | Johnson | |
| 2,825,333 | A | 3/1958 | Broman | |
| 3,750,704 | A | 8/1973 | Burke et al. | |
| 3,779,510 | A | 12/1973 | Krogsrud | |
| 3,788,369 | A | 1/1974 | Killinger | |
| 3,885,703 | A | 5/1975 | Neavin | |
| 3,921,955 | A | 11/1975 | Haddad, Jr. | |
| 4,148,460 | A | 4/1979 | Kinsler | |
| 4,332,369 | A | 6/1982 | Gordon et al. | |
| 4,469,121 | A * | 9/1984 | Moen | F16K 11/085 137/100 |
| 4,494,730 | A * | 1/1985 | George | F16K 5/0271 251/309 |
| 4,512,364 | A | 4/1985 | Phillips | |
| 4,532,969 | A | 8/1985 | Kwaan | |
| 4,573,993 | A | 3/1986 | Hoag et al. | |
| 4,587,989 | A | 5/1986 | Mayhew, Jr. | |
| 4,675,020 | A | 6/1987 | McPhee | |
| 4,759,756 | A | 7/1988 | Forman et al. | |
| 4,769,012 | A | 9/1988 | Quang et al. | |
| 4,802,506 | A | 2/1989 | Aslanian | |
| 4,863,454 | A | 9/1989 | LaBove | |
| 4,900,322 | A | 2/1990 | Adams | |
| 4,997,430 | A | 3/1991 | Van der Heiden et al. | |
| 5,083,743 | A | 1/1992 | Gordon et al. | |
| 5,113,904 | A | 5/1992 | Aslanian | |
| 5,123,574 | A | 6/1992 | Poulos | |
| 5,446,220 | A | 11/1995 | Brenneman | |
| 5,526,853 | A | 6/1996 | McPhee et al. | |
| 5,647,845 | A | 7/1997 | Haber et al. | |
| 5,755,683 | A | 5/1998 | Houle et al. | |
| 5,832,959 | A | 11/1998 | Szymczakowski et al. | |
| 5,893,397 | A | 4/1999 | Peterson et al. | |
| 6,159,192 | A | 12/2000 | Fowles et al. | |
| 6,221,041 | B1 | 4/2001 | Russo | |
| 6,238,372 | B1 | 5/2001 | Zinger et al. | |
| 6,379,340 | B1 | 4/2002 | Zinger et al. | |
| 6,427,713 | B1 | 8/2002 | Dempsey et al. | |
| 6,536,742 | B2 | 3/2003 | Lotz et al. | |
| 6,558,365 | B2 | 5/2003 | Zinger et al. | |
| 6,607,179 | B2 | 8/2003 | Moretti et al. | |
| 6,948,522 | B2 | 9/2005 | Newbrough et al. | |
| 7,152,845 | B2 | 12/2006 | Carrez et al. | |
| 7,165,570 | B1 * | 1/2007 | Lordahi | F16K 11/078 137/454.6 |
| 7,326,194 | B2 | 2/2008 | Zinger et al. | |
| 7,469,716 | B2 | 12/2008 | Parrino et al. | |
| 7,491,197 | B2 | 2/2009 | Jansen et al. | |
| 7,540,863 | B2 | 6/2009 | Haindl | |
| 7,879,018 | B2 | 2/2011 | Zinger et al. | |
| 8,025,653 | B2 | 9/2011 | Capitaine et al. | |
| 8,122,923 | B2 | 2/2012 | Kraus et al. | |
| 8,226,627 | B2 | 7/2012 | Fowles et al. | |
| 8,506,548 | B2 * | 8/2013 | Okiyama | A61J 1/2096 604/406 |
| 8,545,476 | B2 | 10/2013 | Ariagno et al. | |
| 8,763,640 | B2 | 7/2014 | Kojima et al. | |
| 8,821,436 | B2 | 9/2014 | Mosler et al. | |
| 8,905,994 | B1 | 12/2014 | Lev et al. | |
| 8,979,792 | B2 | 3/2015 | Lev et al. | |
| 9,132,063 | B2 | 9/2015 | Lev et al. | |
| 9,345,640 | B2 | 5/2016 | Mosler et al. | |
| 9,345,643 | B2 | 5/2016 | Okiyama | |
| 9,358,181 | B2 | 6/2016 | Ariagno et al. | |
| 9,371,921 | B2 | 6/2016 | Whitaker | |
| 9,435,447 | B2 | 9/2016 | Wattellier et al. | |
| 9,539,387 | B2 | 1/2017 | Fini et al. | |
| 9,568,112 | B2 | 2/2017 | Walker et al. | |
| 10,391,031 | B2 * | 8/2019 | Yevmenenko | A61J 1/2072 |
| 2013/0226100 | A1 | 8/2013 | Lev | |
| 2018/0003303 | A1 | 1/2018 | Peirsman et al. | |

* cited by examiner

BINARY CONNECTOR FOR DRUG RECONSTITUTION

FIELD

The present disclosure relates generally to the preparation and administration of intravenous solutions, and more specifically to a connector device for reconstituting a medication.

BACKGROUND

Some medications are manufactured in a concentrated liquid form that requires mixture with another liquid or "diluent" prior to being administered to a patient. Other medications are manufactured in a concentrated powder form that also requires mixture with a diluent prior to being administered to a patient. This mixing of concentrated medication with diluent, sometimes called "reconstitution", creates a drug solution or suspension that can be administered to a patient using an intravenous (IV) bag or container.

Medications and diluents are often stored separately. One reason for this is that drug solutions often have a relatively short shelf life after mixing. Keeping medications and diluents separate also allows a pharmacy to bulk prepare commonly used medications for an entire facility. Therefore, it is desirable to keep the medication and diluent separate until right before the drug solution is needed. Thorough mixing of medication with a diluent can take time, however. This can delay administration of the drug solution, costing a precious amount of time for patients who require urgent treatment.

To address these challenges, special IV containers, referred to herein as "solution containers", have been developed. A solution container has a port that allows concentrated medication to be transferred into the container and mixed with the diluent. This allows a drug solution to be prepared in the solution container a short time before the drug solution is needed.

Special adaptors have also been developed that allow concentrated medication stored in vials to be transferred into solution containers. These adaptors create fluid conduits between the drug vials and solution containers. A typical adapter has a first cannula or spike for connection to a port on a drug vial. The adapter also has a second cannula or spike for connection to a solution container. The vial spike can have a coring configuration designed to puncture a silicone septum on the drug vial and remove a piece of the septum or "plug" that remains lodged inside the spike. The plug blocks flow between the drug vial and adaptor, preventing flow between the adaptor and drug vial. In this plugged state, the adaptor interconnects the drug vial and solution container in a "ready-to-mix" assembly, but the drug and diluent are intended to remain separated.

When the drug solution is needed, the adaptor is designed in principle to be "activated". To activate the adaptor, the user squeezes the solution container, which creates fluid back pressure against the plug in the vial spike. This back pressure expels the plug from the vial spike into the vial, opening the passage between the adaptor and drug vial. The opened passage between the adaptor and drug vial allows diluent to enter the drug vial and mix with the drug to create a drug solution that flows back into the solution container.

Adaptors can simplify the preparation of drug solutions but have drawbacks that limit their effectiveness. As an initial concern, the correct use of adaptors is not intuitive for all users. For example, some users may incorrectly assume that connecting an adaptor between a drug vial and solution container will immediately establish an open fluid passage that allows mixing of the drug with diluent. This can discourage users from pre-assembling the adaptor with the drug vial and solution bag ahead of time, out of fear that premature mixing will take place.

Other users may be unsure of how to activate the adaptor. This can result in users mishandling the solution bag, drug vial and/or anchor, resulting in accidental leakage or release of the drug or diluent from the system.

Another drawback is the absence of an indicator that informs the user whether the adaptor is activated. This can make users uncertain about whether the passage between the drug vial and solution container is open or closed. Such uncertainty can lead to doubt and concern about whether seepage or mixing has taken place during storage. Any mixture created during storage can expire and become unsafe for use. Therefore, if there is any doubt about activation, the user must discard the system.

Still another drawback is the possibility of accidental activation of the adaptor. Lack of care in handling and storing the assembled system can subject the system to compression loading, vibration, shock or other condition that causes the plug to dislodge from the vial spike. If the plug dislodges from the vial spike, and there is no seal between the connector and solution container, then the passage between the adaptor and drug vial will open, allowing mixing to take place.

Still another drawback is a lack of safety features that inform users that an adapter has been tampered with or used for a previous drug reconstitution. Adaptors should only be used once and then discarded. Unfortunately, it is possible to disconnect adaptors from solution containers after activation and restock them for reuse. Reuse of an adaptor can create a serious risk of infection or cross-contamination with a drug that was previously reconstituted with the adaptor.

The foregoing drawbacks illustrate the need for improved adaptors that are safer, more intuitive to use, and less prone to accidental or undesired mixing of drugs and diluents.

SUMMARY

The drawbacks of conventional adaptors are resolved in many respects with binary connectors in accordance with the present disclosure.

In one aspect of the disclosure, a connector can be configured for fluidly connecting a drug container with a solution container in a closed state, and for combining contents of the drug container and the solution container in an activated state.

In another aspect of the disclosure, the connector can include a connector body having a first coupling for fluid connection with the drug container. The first coupling can define a first fluid passage.

In another aspect of the disclosure, the connector can include a second coupling for fluid connection with the solution container. The second coupling can define a second fluid passage.

In another aspect of the disclosure, the connector can have a control valve with a movable valve body. The valve body can define a third fluid passage.

In another aspect of the disclosure, the valve body can be positionable relative to the connector body in a first position, in which the first fluid passage is sealed from the second fluid passage to place the connector in the closed state.

In another aspect of the disclosure, the valve body can be positionable relative to the connector body in a second position, in which the first fluid passage is connected in fluid communication with the second fluid passage by the third fluid passage to place the connector in the activated state.

In another aspect of the disclosure, the first fluid passage can extend parallel to the second fluid passage.

In another aspect of the disclosure, the first coupling can include a first piercing member having a first hollow body defining the first fluid passage.

In another aspect of the disclosure, the second coupling can include a second piercing member having a second hollow body defining the second fluid passage.

In another aspect of the disclosure, the valve body can include a shaft extending into the connector body, the shaft being rotatable relative to the connector body on a control axis.

In another aspect of the disclosure, the third fluid passage can extend through the shaft transversely to the control axis.

In another aspect of the disclosure, the third fluid passage can define a first opening on a first side of the shaft and a second opening on a second side of the shaft.

In another aspect of the disclosure, the first opening can be diametrically opposite the second opening on the shaft.

In another aspect of the disclosure, the shaft can be cylindrical and include a cylindrical shaft surface.

In another aspect of the disclosure, the control valve can include a seal body that surrounds the shaft surface.

In another aspect of the disclosure, the seal body can define a seal body passage having a passage wall that slidingly engages the shaft surface.

In another aspect of the disclosure, the seal body passage can include a first passage end, a second passage end, and an inner diameter that varies between the first passage end and second passage end.

In another aspect of the disclosure, the seal body passage can form one or more sections of reduced diameter configured to engage, wipe and form one or more seals with the cylindrical shaft surface.

In another aspect of the disclosure, the passage wall can include at least one annular seal that forms a seal interface between the seal body and the shaft.

In another aspect of the disclosure, the seal body can define a first aperture that forms a first conduit between the seal body passage and the first flow passage, and a second aperture that forms a second conduit between the seal body passage and the second flow passage.

In another aspect of the disclosure, the first conduit and second conduit can be axially aligned with one another and located on opposite sides of the seal body passage.

In another aspect of the disclosure, the third fluid passage can be aligned with the first conduit and the second conduit when the connector is in the activated state.

In another aspect of the disclosure, the third fluid passage can be rotated out of alignment with at least one of the first conduit and the second conduit when the connector is in the closed state.

In another aspect of the disclosure, the seal body can include an exterior surface having at least one sealing rib around the first aperture and at least one sealing rib around the second aperture.

In another aspect of the disclosure, the control valve can include a control handle attached to the shaft.

In another aspect of the disclosure, the control handle can be rotatable relative to the connector body to rotate the shaft about the control axis.

In another aspect of the disclosure, the control handle can be rotated to a first orientation in which the valve body is in the first position to place the connector in the closed state.

In another aspect of the disclosure, the control handle can be rotated to a second orientation in which the valve body is in the second position to place the connector in the activated state.

In another aspect of the disclosure, the control handle can include a lock that prevents rotation of the valve body from the second position to the first position.

In another aspect of the disclosure, the lock can include a first locking element on the control handle and a second locking element on the connector body.

In another aspect of the disclosure, the first locking element can be configured to engage the second locking element when the control handle is rotated to the second orientation.

In another aspect of the disclosure, the first locking element can include at least one ratchet tooth, and the second locking element can include a ledge.

In another aspect of the disclosure, the control handle can include a first rotation limiter and the connector body can include a second rotation limiter.

In another aspect of the disclosure, the first rotation limiter can be configured to abut the second rotation limiter when the control handle is rotated to the second orientation to prevent the control handle from rotating past the second orientation.

In another aspect of the disclosure, the first coupling can include a plurality of flexible tabs arranged in a circular arrangement around the first fluid passage.

In another aspect of the disclosure, the plurality of flexible tabs can define a first socket sized to receive the drug container.

In another aspect of the disclosure, the first coupling can include an adapter ring detachably connected to the first socket.

In another aspect of the disclosure, the adapter ring can be sized to receive an alternate drug container having a different configuration than the drug container.

BRIEF DESCRIPTION OF THE DRAWING FIGURES

The foregoing summary and the following detailed description will be better understood in conjunction with non-limiting examples shown in the drawing figures, of which:

DETAILED DESCRIPTION

Figure 1:
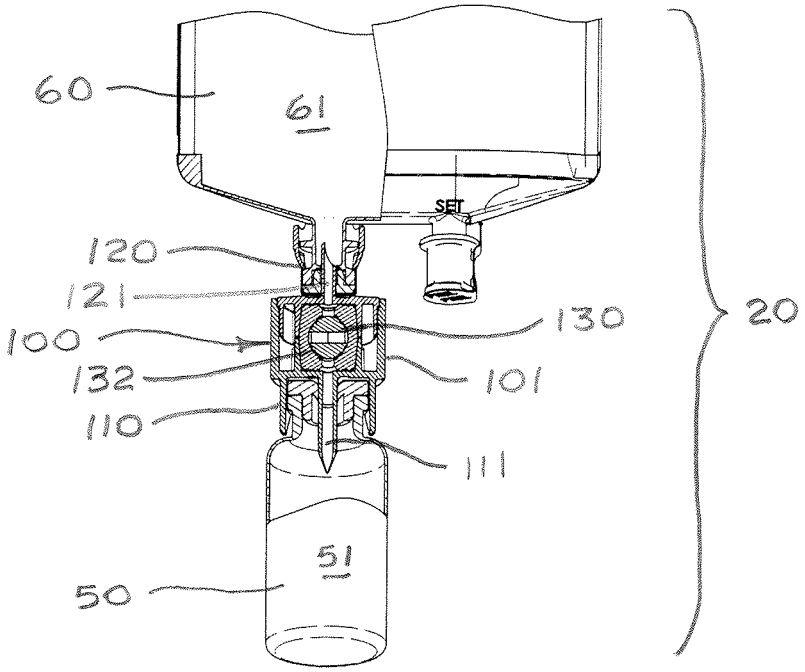
FIG. 1 is a front cross sectional view of a connector according to one example of the present disclosure, the connector shown attached to a drug vial and solution container in a first operative state.
Figure 2:
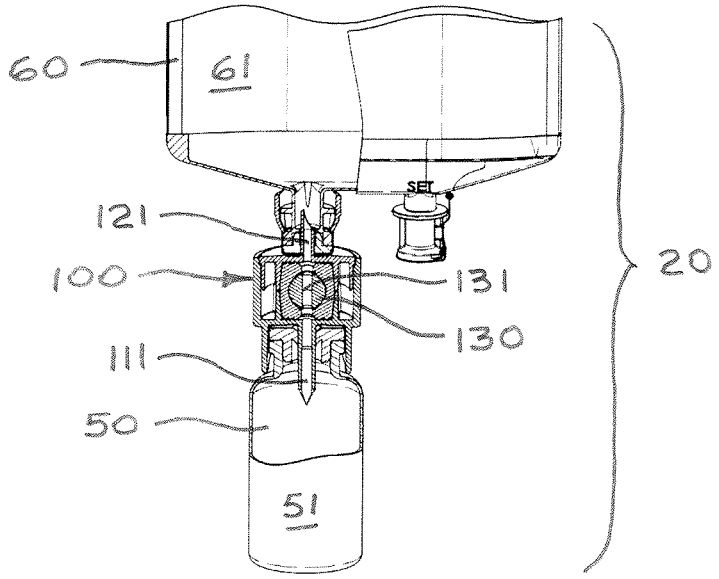
FIG. 2 is another front cross sectional view of the connector of FIG. 1, shown in a second operative state.

Referring to the drawing figures generally, and FIGS. 1 and 2 in particular, a connector 100 for connecting a drug vial 50 with a solution container 60 is shown according to one example. Connector 100 has a connector body 101 with a first coupling 110 and a second coupling 120. First coupling 110 is connected to drug vial 50, which contains a drug 51. Second coupling 120 is connected to solution container 60, which contains a diluent 61. In this arrangement, connector 100 connects drug vial 50 and solution container 60 to create an assembly or set 20 for reconstituting drug 51.

Set 20 provides a convenient way to store drug vial 50 and solution container 60 in a pre-connected, "ready-to-mix" assembly. Drug vial 50 and solution container 60 are not stored in a fluidly connected state, however. Instead, drug vial 50 and solution container 60 are stored in a sealed off arrangement, in which connector 100 prevents drug 51 from combining with diluent 61, and vice versa. This sealed off arrangement is established independent of any plug that may or may not be created in either coupling. Fluid communication between drug vial 50 and solution container 60 is established only when a user activates the connector 100 to allow mixing to take place. Once connector 100 is activated, various indicators on the device inform the user that the connector is activated. Connector 100 remains locked in the activated state after activation, preventing the connector from being reused.

FIG. 1 provides a cross sectional view of connector 100, and partial cross section views of drug vial 50 and solution container 60. Connector 100 is shown in a "closed state", in which the connector interconnects drug vial 50 and solution container 60 in a sealed arrangement that prevents drug 51 from mixing with diluent 61. The transfer of fluid between drug vial 50 and solution container 60 is prevented by a control valve 130, which is shown in a closed condition.

FIG. 2 provides another cross sectional view of connector 100, and partial cross sectional views of drug vial 50 and solution container 60. Connector 100 is shown in the activated state, in which the connector interconnects drug vial 50 and solution container 60 in an unsealed arrangement that permits drug 51 to mix with diluent 61. The transfer of fluid between drug vial 50 and solution container 60 is permitted by control valve 130, which is shown in an open condition.

Couplings according to the present disclosure can include fluid passages in various shapes and configurations that allow mixing of drugs with diluents. Each fluid passage can be made up of a single straight segment, a single curved segment, multiple straight segments, multiple curved segments, or a combination of straight and curved segments. In addition, each fluid passage can have a uniform cross section along its entire length, or one or more changes in cross section.

In the present example, first coupling 110 defines a first fluid passage 111 having a single linear segment and a uniform cross section along its length. Likewise, second coupling 120 defines a second fluid passage 121 having a single linear segment and a uniform cross section along its length. First and second fluid passages 111, 121 are axially aligned to one another. The linear and uniform profiles of first and second fluid passages 111, 121 provide minimal transitions to allow transfer of fluid smoothly through connector 100.

Control valve 130 includes a valve body 132 defining a third fluid passage 131. Third fluid passage 131 extends through valve body 132, and can be aligned with first fluid passage 111 and second fluid passage 121 to allow fluid to flow between drug vial 50 and solution container 60. The orientation of third fluid passage 131 relative to first and second flow passages 111, 121 is dictated by the orientation of valve body 132 relative to connector body 101.

Valve body 132 is positionable relative to connector body 101 in a first position, shown in FIG. 1. In this position, third fluid passage 131 is not aligned with first and second fluid passages 111, 121. First fluid passage 111 is sealed from second fluid passage 121 by a number of sealed interfaces, as will be explained. Thus, connector 100 physically connects drug vial 50 and solution bag 60, but does not provide fluid communication between them.

Valve body 132 is movable from the first position to the second position, shown in FIG. 2. In this position, third fluid passage 131 is axially aligned with first and second fluid passages 111, 121. Therefore, third fluid passage 131 fluidly connects first fluid passage 111 with second fluid passage 121, and vice versa. As such, connector 100 physically connects drug vial 50 and solution bag 60, and provides fluid communication between them.

Connectors according to the present disclosure can feature any suitable coupling that allows the connector body to establish a fluid connection with fluid containers. Suitable couplings can include but are not limited to various types of needles, cannulas, spikes, and other tubular or non-tubular connectors that pierce or plug into an access port, stopper or other access point on a fluid container. Suitable couplings can also include various types of port structures, stoppers or other access points configured to receive needles, cannulas, spikes, and other tubular or non-tubular connectors that pierce or plug into them. Piercing connectors according to the present disclosure can have a coring configuration to remove a plug from a stopper or septum that remains in the connector to temporarily block flow through the fluid passage. Alternatively, couplings according to the present disclosure can utilize non-coring connectors. Thus, connectors according to the present disclosure do not require plugs to control activation.

Referring to FIGS. 3A, 3B, 11A and 11B, first coupling 110 includes a first piercing member in the form of a vial spike 112. Vial spike 112 has a first hollow body 114 that defines the first fluid passage 111. First hollow body 114 also has a pointed tip 115 and defines a longitudinal slot 116 on one side. First coupling 110 further includes four flexible tabs 113 that surround vial spike 112. Tabs 113 collectively form a socket 118 configured to receive the neck portion of drug vial 50, as shown in FIGS. 1 and 2. Tabs 113 firmly latch around drug vial 50 to limit lateral movement of the drug vial after it is connected to first coupling 110.

Connectors according to the present disclosure can be configured to attach to vials of a certain type. For example, the connectors can have sockets designed to only accommodate vials of a selected size. These connectors can include adaptors that allow the connectors to attach to vials that do not have the selected size. In the present example, socket 118 is configured to attach to a 20 mm vial. An optional adaptor 190, shown in FIG. 4, can be inserted into socket 118 to allow connector 100 to attach to a 13 mm vial. Adaptor 190 has a plurality of flexible tabs 191 forming a socket 192 that is a smaller version of socket 118 and sized proportional to a 13 mm vial. Additional adaptors having other sizes can be provided with connector 100 that allow the connector to attach to vials of other sizes.

Referring again to FIGS. 3A, 3B, 11A and 11B, second coupling 120 includes a second piercing member in the form of a cannula 122. Cannula 122 has a second hollow body 124 that defines the second fluid passage 121. Second hollow body 124 also has a pointed tip 125. A pair of flanges 123 extend beyond cannula 122, forming a saddle-shaped receiver 127 that partially surrounds the cannula. Receiver 127 is configured to slide over the sides of solution container 60, receive a port on the solution container, and allow the port on the solution container to connect with cannula 122 in a secure arrangement.

Figure 11A:
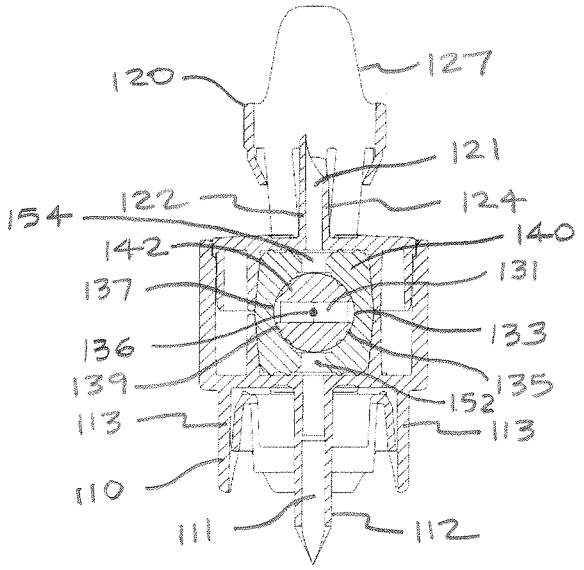
FIG. 11A is front cross sectional view of the connector of FIG. 1, with the valve body positioned in a first position.
Figure 11B:
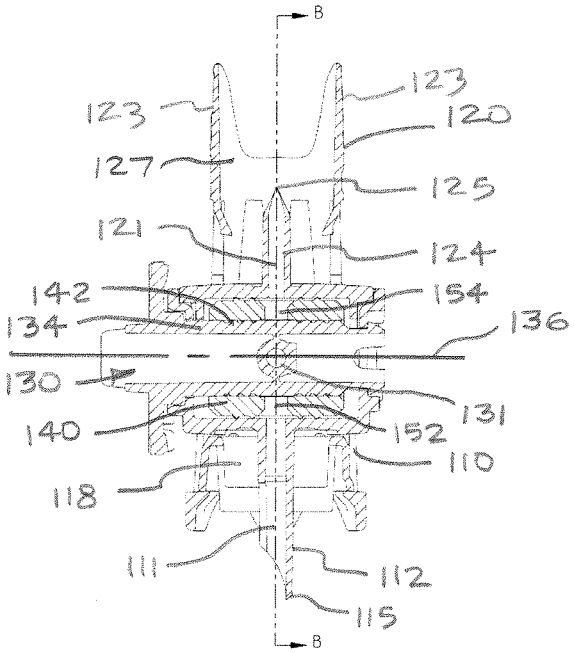
FIG. 11B is a side cross sectional view of the connector of FIG. 1, with the valve body positioned in the first position.

Referring now to FIGS. 4-6, 11A and 11B, valve body 132 features a cylindrical shaft 134 that extends into connector body 101. Shaft 134 has a first end 134*a* that extends through one side of connector body 101 and a second end 134*b* that extends through the opposite side of the connector body. Shaft 134 is rotatable relative to connector body 101 on a control axis 136. Third fluid passage 131 extends through the shaft perpendicularly to control axis 136, as shown in FIG. 11B. Third fluid passage 131 also defines a first opening 133 on a first side 135 of the shaft, and a second opening 137 on a second side 139 opposite the first side of the shaft. Shaft 134 includes a cylindrical shaft surface 138 that forms one part of a seal interface, as will be explained.

Control valve 130 includes a seal body 140 that cooperates with valve body 132 to control the flow of fluid through connector 100. Seal body 140 defines a passage 142 having a passage wall 144. Passages and passage walls according to the present disclosure can have various cross sectional geometries for sealingly engaging the seal body, including but not limited to regular polygonal, irregular polygonal, elliptical, oval and circular. In the present example, passage 142 has a circular cross section so as to form a cylindrical passage.

Figure 7:
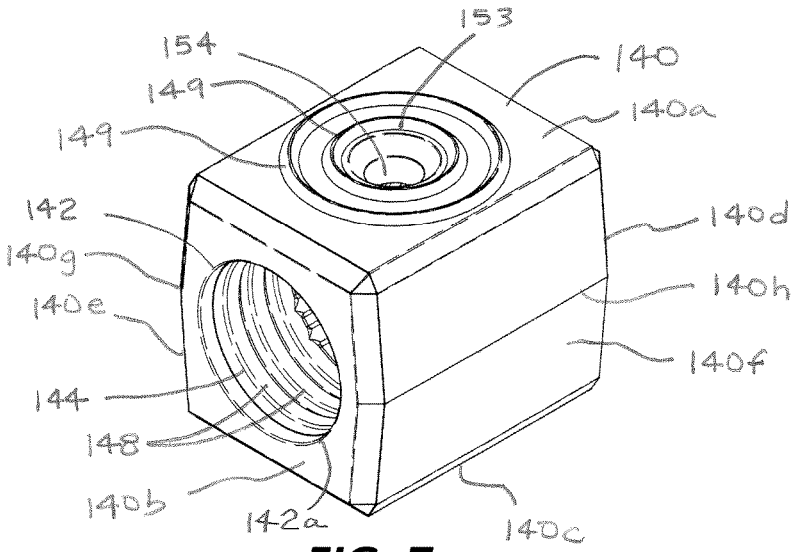
FIG. 7 is an enlarged perspective view of a seal body of the connector of FIG. 1.
Figure 8:
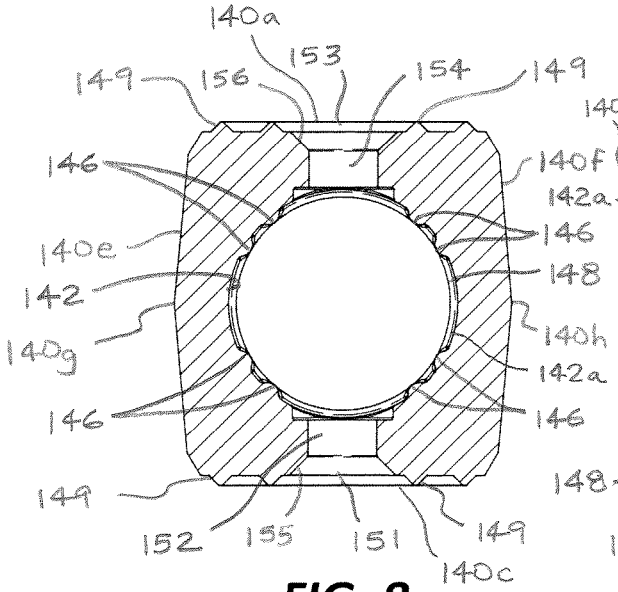
FIG. 8 is a first cross sectional view of the seal body of the connector of FIG. 1.
Figure 9:
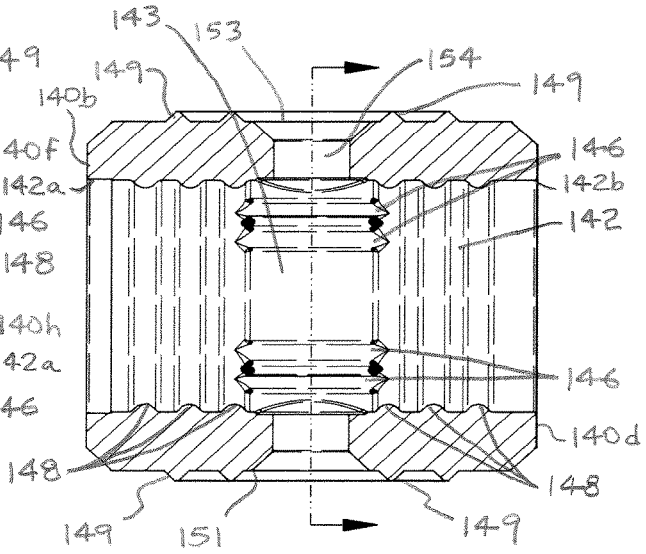
FIG. 9 is a second cross sectional view of the seal body of the connector of FIG. 1.

Referring to FIGS. 7-9, passage 142 has a first passage end 142*a* and a second passage end 142*b* opposite the first passage end. Passage 142 also defines an inner diameter that varies between first passage end 142*a* and second passage end 142*b*. The inner diameter varies to form sections of reduced diameter that are configured to engage, wipe and form seals with shaft surface 138, as will be explained. Shaft surface 138 slidingly engages passage wall 144 while maintaining a sealed interface with the passage wall. In this arrangement, seal body 140 surrounds shaft surface 138 and forms a seal interface between the seal body and shaft surface during movement of valve body 132.

Seal body 140 defines a first aperture 151 and a first conduit 152. First aperture 151 and first conduit 152 extend between cylindrical passage 142 and first flow passage 111, as seen in FIG. 11A. Seal body 140 also defines a second aperture 153 and a second conduit 154. Second aperture 153 and second conduit 154 extend between cylindrical passage 142 and second flow passage 121, as seen in FIG. 11A. First conduit 152 includes a first tapered section 155 that expands radially outwardly and widens toward first aperture 151. Second conduit 154 includes a second tapered section 156 that expands radially outwardly and widens toward second aperture 153. First conduit 152 and second conduit 154 are axially aligned with one another and extend transversely to cylindrical passage 142.

Referring to FIGS. 11A-13B, shaft 134 is rotatable relative to seal body 140 and connector body 101 during operation of control valve 130. Shaft 134 can be rotated ninety degrees between a first shaft position and second shaft position. In the first shaft position, third fluid passage 131 extends perpendicular to, and out of alignment with, first and second conduits 152, 154 and first and second flow passages 111, 121. This position, shown in FIG. 11A, places connector 100 in the closed state. In the second shaft position, third fluid passage 131 is parallel to and axially aligned with first and second conduits 152, 154 and first and second flow passages 111, 121. This position, shown in FIG. 13A, places connector 100 in the activated state. First flow passage 111, first conduit 152, third flow passage 131, second conduit 154 and second flow passage 121 align end to end to create a singular and continuous linear flow passage through connector 100 when the connector is in the activated state. Seal body 140 is positioned in connector body 101 so that first conduit 152 is always axially aligned with first flow passage 111, and second conduit 154 is always axially aligned with second flow passage 121.

Connectors according to the present disclosure can feature one or more seal interfaces. The seal interface(s) prevent fluid flow between a drug vial and solution container when the connector is in the closed state. In addition, the seal interface(s) prevent unwanted flow of fluid within the connector when the connector is in either the closed state or activated state. For example, one or more seal interfaces can be provided between the valve body and seal body to limit or prevent seepage of fluid in spaces between the valve body and seal body. In addition, or in the alternative, one or more seal interfaces can be provided between the seal body and connector body to limit or prevent seepage of fluid in spaces between the seal body and connector body.

Referring back to FIGS. 7-9, seal body 140 has four substantially planar sides 140*a*, 140*b*, 140*c*, 140*d*. Seal body 140 also has two tapered sides 140*e*, 140*f* arranged on opposite sides of the seal body. Each tapered side 140*e*, 140*f* tapers outwardly and away from cylindrical passage 142, forming a V-shaped face. The V-shaped face of tapered side 140*e* forms a vertex along a midline 140*g*, and the V-shaped face of tapered side 140*f* forms a vertex along a midline 140*h* parallel to midline 140*g*. In this configuration, seal body 140 has a generally hexagonal cross section conforming to two trapezoids that intersect, as shown in FIG. 8. This hexagonal cross sectional shape aids the insertion of seal body 140 into connector body 101, as will be explained. The hexagonal cross sectional shape also distributes compression loading more uniformly around shaft 134.

Referring to FIGS. 12A-13B, connector body 101 defines a chamber 103 that houses seal body 140. Chamber 103 has an internal geometry that conforms to the outer geometry of seal body 140. In particular, chamber 103 includes interior walls 104 that have a V-shaped geometry conforming to tapered sides 140*e*, 140*f*. Seal body 140 is made of a resilient seal material such as silicone. The outer diameter of shaft surface 138 is slightly greater than the inner diameter of cylindrical passage 142. In this arrangement, insertion of shaft 134 into cylindrical passage 142 during assembly pushes the walls of seal body 140 outwardly, expanding the seal body. This outer expansion causes seal body 140 to bear against interior walls 104 in chamber 103, creating an outer seal around the seal body.

Referring again to FIGS. 7-9, seal body 140 also forms outer seals around areas of chamber 103 that intersect with first and second flow passages 111, 121. In particular, planar sides 140*a*, 140*c* of seal body 140 each include a pair of concentric ring shaped seals 149. Ring shaped seals 149 surround first and second apertures 151, 153, respectively. Each ring shaped seal 149 forms an outward protrusion or rib that contacts an interior wall 104 of connector body 101. In this arrangement, ring shaped seals 149 entrap fluid that seeps from the flow passages into areas between seal body 140 and connector body 101, preventing that fluid from migrating beyond the ring shaped seals.

Seal body 140 further defines inner seals between passage wall 144 and shaft 134. Some of the inner seals are arranged in a central portion 143 of cylindrical passage 142 that surrounds the third flow passage 131, as shown in FIG. 9. Other inner seals are arranged in cylindrical passage 142 outside of central portion 143.

The inner seals include eight circumferential seals 146 on passage wall 144 in central portion 143. Each circumferential seal 146 is a short, linear, inwardly extending protrusion or rib that extends parallel to control axis 136 and contacts shaft surface 138 in a sealing engagement. In this arrangement, circumferential seals 146 entrap fluid that seeps from first conduit 152 and/or second conduit 154 into the space between shaft surface 138 and passage wall 144, preventing further flow of that fluid in a circumferential direction relative to control axis 136.

The inner seals also include six axial seals 148 on passage wall 144 outside of central portion 143. Three axial seals 148 are positioned on one side of third flow passage 131, and the other three axial seals are positioned on the opposite side of the third flow passage. Each axial seal 148 is a ring-shaped, annular, inwardly extending protrusion or rib that circumscribes control axis 136 and contacts shaft surface 138 in a sealing engagement. In this arrangement, axial seals 148 entrap fluid that seeps between shaft surface 138 and passage wall 144 and prevents further flow of that fluid in an axial direction parallel to control axis 136.

Seals according to the present disclosure can have different cross sectional shapes. Two options include trapezoidal shaped seals and rounded seals. Trapezoidal seals generally provide a better seal than rounded seals because they provide greater deflection with less compressive force to create the required pressure differential between seals. However, rounded seals undergo less damage than trapezoidal seals in instances where the seals rub against adjacent surfaces during assembly. This resistance to damage can outweigh the superior sealing properties of trapezoidal seals if the stresses on the seals are significant. Therefore, the specific shape of a seal can be selected based on factors such as its location and the stresses it is subjected to during assembly.

In the present example, ring shaped seals 149 are trapezoidal in cross section, as seen in FIGS. 8 and 9. This shape provides more deflection of the seal with less compressive force to create the required pressure differential between the seals. Circumferential seals 146 and axial seals 148 have oval or elliptical shaped cross sections. These shapes are more rounded to allow insertion of shaft 134 into cylindrical passage 142 without causing damage to the seals. The oval or elliptical shapes of circumferential seals 146 and axial seals 148 also provide the largest possible sealing surfaces against shaft 134.

Control valves according to the present disclosure are the mechanisms used to activate the connector. Once the connector is activated, the drug vial and solution container are connected in fluid communication, allowing mixing to take place. Connectors according to the present disclosure can include mechanisms to prevent accidental activation so as to avoid pre-mature mixing before the medication is needed. In addition, connectors according to the present disclosure can include mechanisms that inform users about the operative condition of the connector, i.e. whether the connector is closed or activated. Moreover, connectors according to the present disclosure can include mechanisms that allow users operating the control valve to know when they have successfully activated the connector. Finally, connectors according to the present disclosure can include mechanisms that prevent the connectors from being used more than once.

Figure 4:
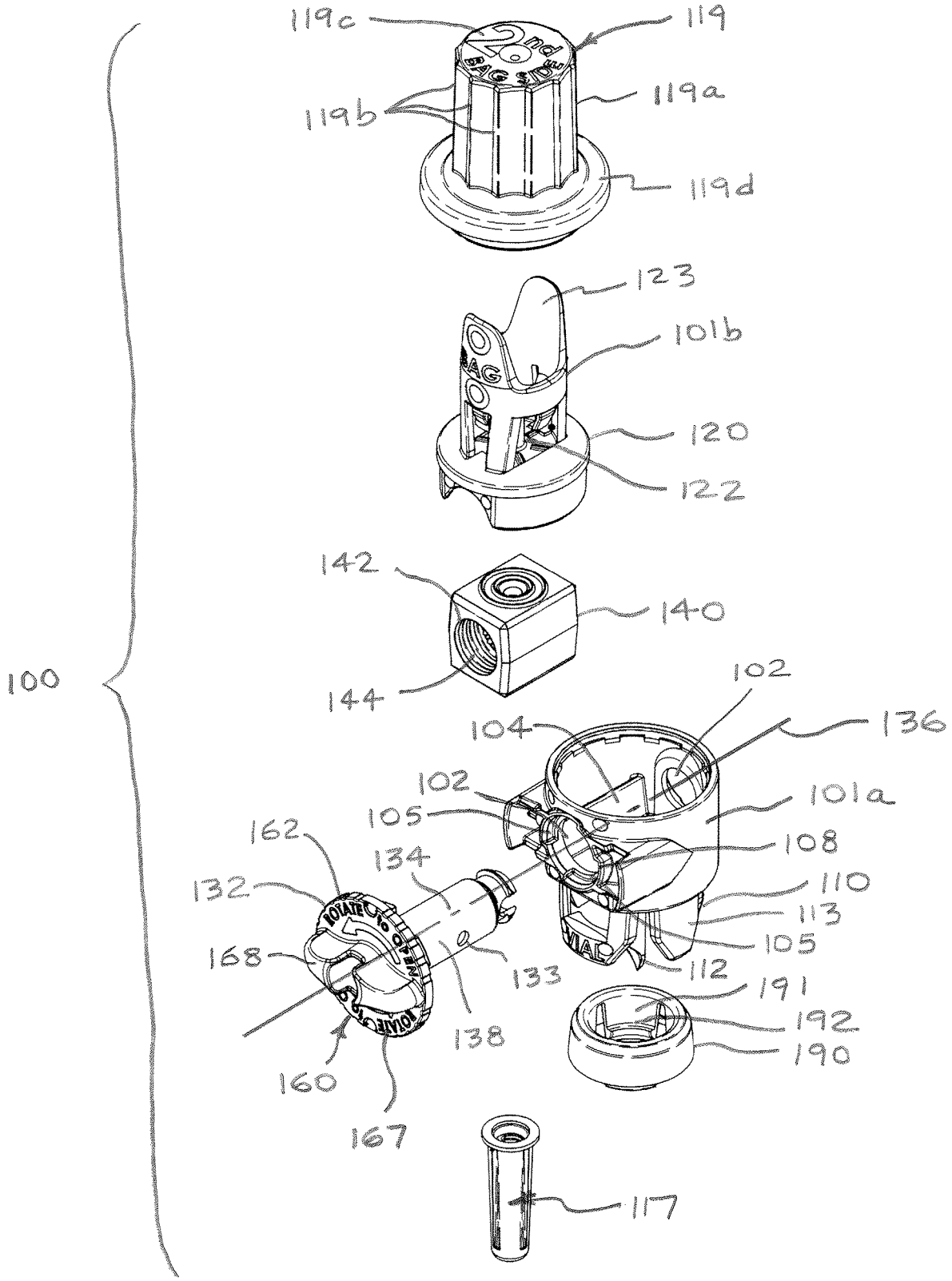
FIG. 4 is an exploded perspective view of the connector of FIG. 1 with additional accessories.
Figure 5:
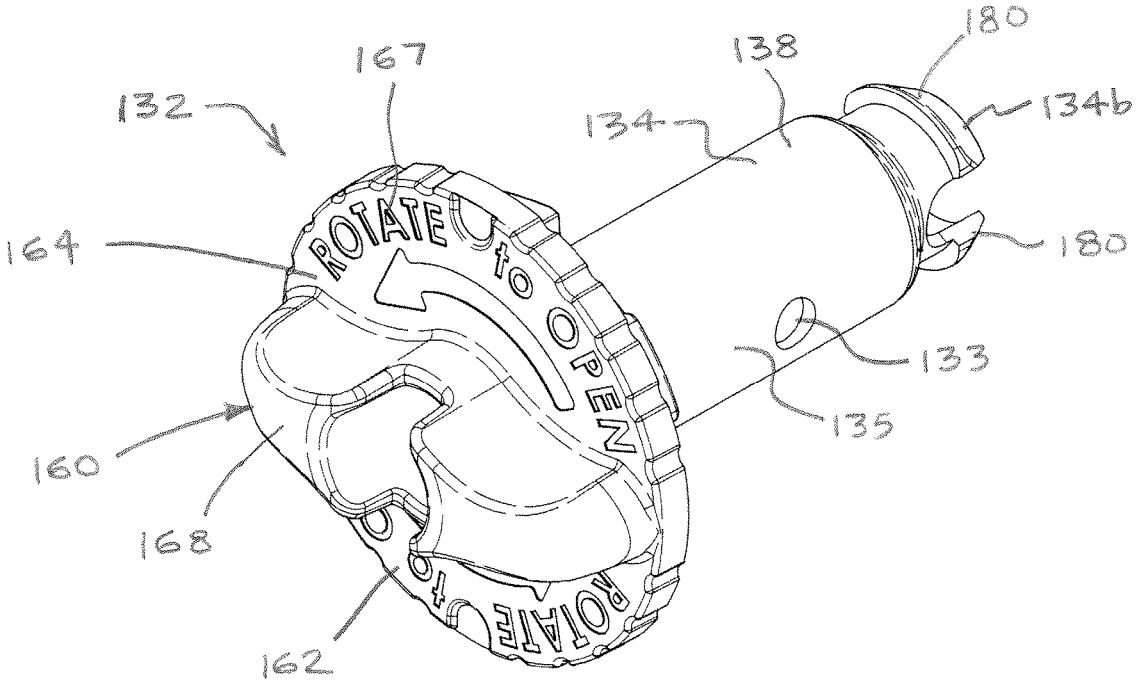
FIG. 5 is an enlarged perspective view of a valve body of the connector of FIG. 1.
Figure 6:
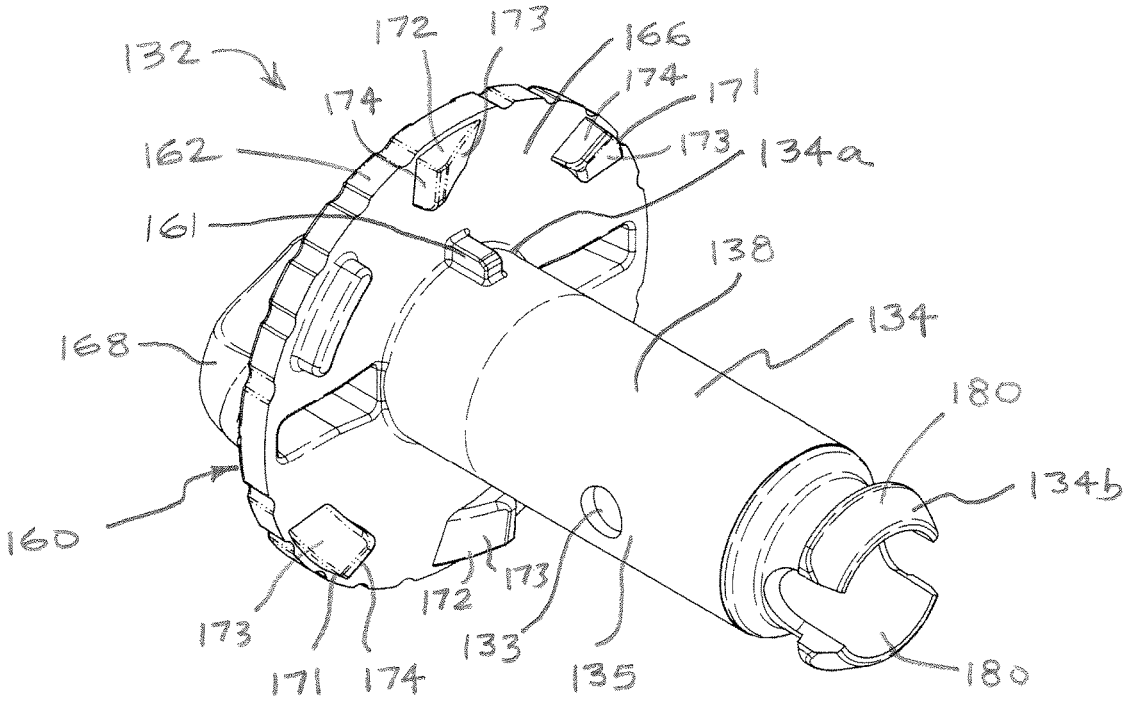
FIG. 6 is another enlarged perspective view of the valve body of the connector of FIG. 1.

In the present example, connector 100 integrates the foregoing mechanisms into valve body 132 generally, and more specifically, into a control handle 160 as shown FIGS. 4-6. Control handle 160, which is part of valve body 132, includes a circular dial 162 attached to first end 134*a* of shaft 134. Dial 162 extends in a plane perpendicular to control axis 136, and is centered on the control axis such that the center of the dial lies on the control axis. A first side 164 of dial faces away from connector body 101, and a second side 166 of the dial faces toward connector body. A finger rest 168 projects outwardly from first side 164 and is configured to allow a user to rotate the dial using their fingers and/or thumbs in a twisting motion. Dial 162 can be rotated to rotate shaft 134 between the first and second shaft positions, thus moving the connector from the closed state to the activated state.

Control handles according to the present disclosure can have different configurations, and need not have circular dials. For example, control handles can also feature a polygonal shaped dial, a T-handle, a knurled knob, or other suitable structure for rotating the shaft.

Shaft 134 is inserted through two openings 102 in the walls of connector body 101. In this position, shaft 134 is rotatable about control axis 136 but has limited ability to translate along control axis. Axial translation of shaft 134 through connector body 101 is limited by dial 162 on one side of the connector body and a pair of tapered flanges 180 on the opposite side of the connector body. Flanges 180 are configured to converge radially inwardly as second end 134*b* is inserted through each of the openings 102 in the wall of connector body 101, and subsequently expand. Once expanded, flanges 180 are larger than openings 102, preventing shaft 134 from being reversed out of connector body 101. This axial fixation of shaft 134 is shown in FIGS. 10A-13B.

Referring to FIGS. 3A-4 and 6, control handle 160 and connector body 101 feature rotation limiters that control how far dial 162 and shaft 134 can be rotated relative to the connector body. Control handle 160 has a first rotation limiter in the form of two stop pegs, pins or tabs 161. One tab 161 is visible through the partial break in FIG. 3A, with the other tab being diametrically opposed and shown in FIG. 6. Connector body 101 has a second rotation limiter in the form of two arc-shaped tracks 105. Each track 105 has a first end wall 106, a second end wall 107, and an arc-shaped pathway 108 extending between the first and second end walls. Each tab 161 is positioned in one of the tracks 105 and movable within its arc-shaped pathway 108 as dial 162 is rotated relative to connector body 101. First and second end walls 106, 107 provide stops that prevent tab 161 from moving beyond the end walls.

Figure 3A:
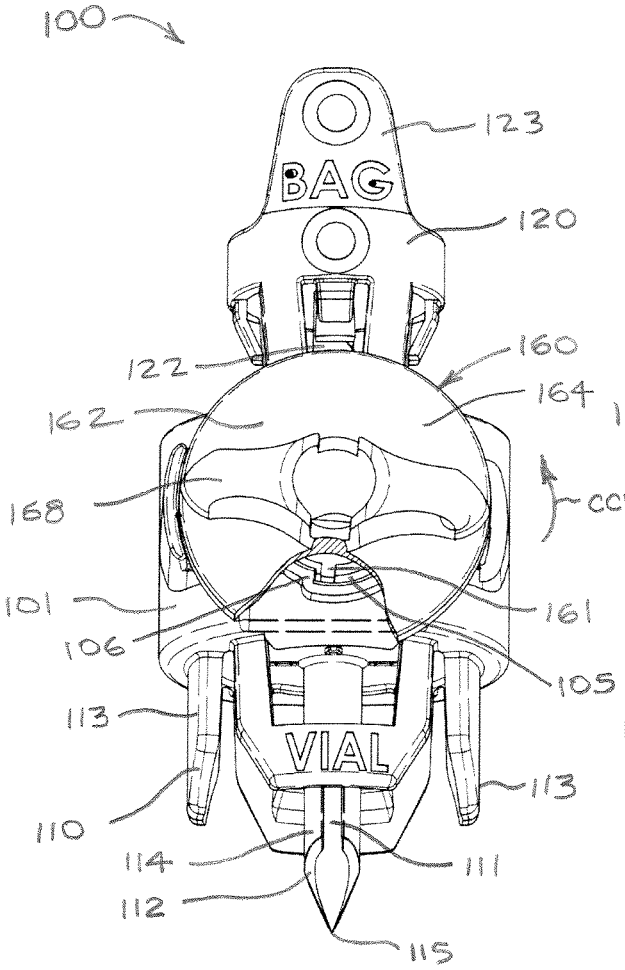
FIG. 3A is a front view of the connector of FIG. 1, with a section broken away to show interior elements of the connector in the first operative state.

When looking at first side 164 of dial 162 in FIG. 3A, the relative positions of tabs 161 in tracks 105 can be described in terms of numbers on a clock face. The counterclockwise direction is represented by the arrow CCW. For brevity, the relative position of the visible tab 161 will be described, with the understanding that the position of the other tab is offset by 6 hours on the clock face (i.e. 180 degrees) and moves in the same manner.

Figure 3B:
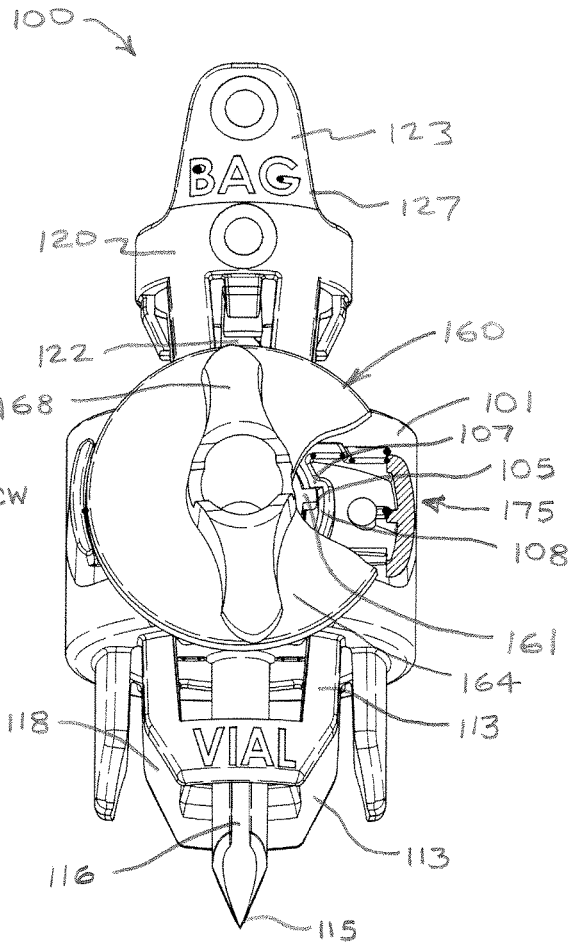
FIG. 3B is a front view of the connector of FIG. 1, with a section broken away to show interior elements of the connector in the second operative state.

The visible tab 161 in FIG. 3A is shown abutting first end wall 106 in the 6 o'clock position. In this position, shaft 134 is oriented in the first shaft position which places the connector in the closed state. The same tab 161 is shown in FIG. 3B abutting second end wall 107 after the tab is rotated counterclockwise ninety degrees to the 3 o'clock position. In this position, shaft 134 is oriented in the second shaft position which places the connector in the activated state. Thus, each tab 161 is movable in its respective track 105 through a range of 90 degrees to move shaft 134 from the first shaft position to the second shaft position. Consequently, dial 162 can be rotated counterclockwise ninety degrees, starting from the first orientation shown in FIG. 3A, and ending in the second orientation shown in FIG. 3B, in order to switch connector 100 from the closed state to the activated state. To maintain the connector in the activated state, second end wall 107 stops tab 161 at the 3 o'clock position to prevent counterclockwise rotation of shaft 134 past the second shaft position.

Figure 10A:
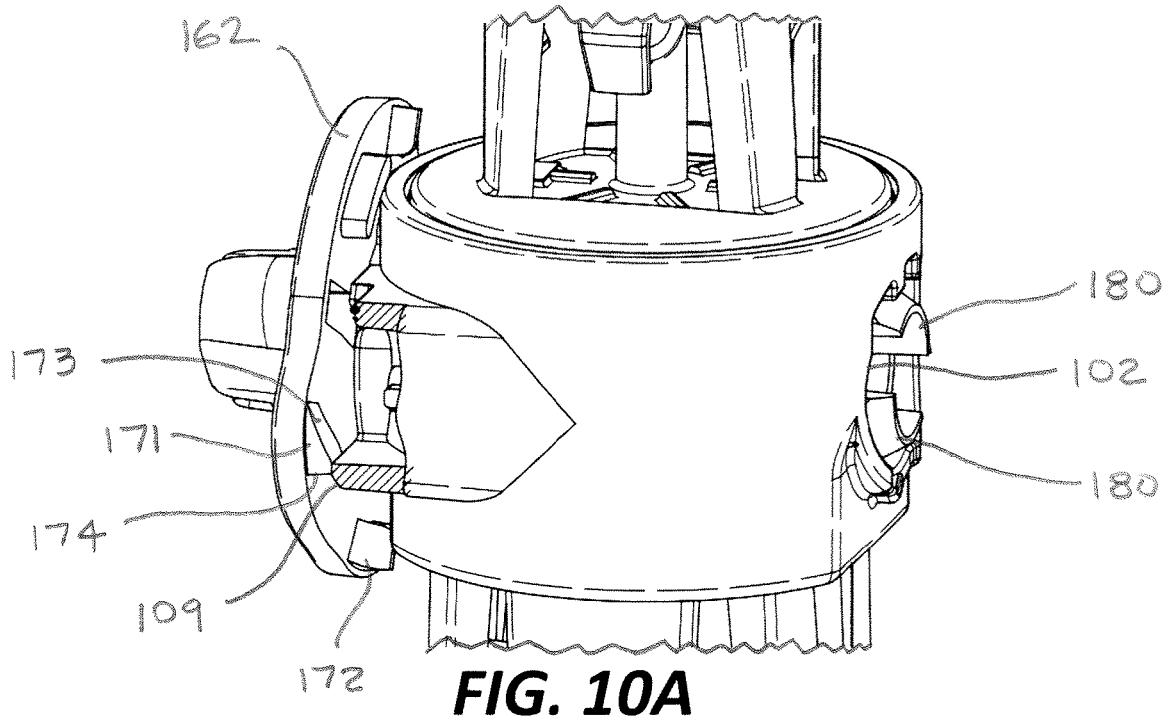
FIG. 10A is a truncated perspective view of the connector of FIG. 1, with a dial rotated to a first position.
Figure 10B:
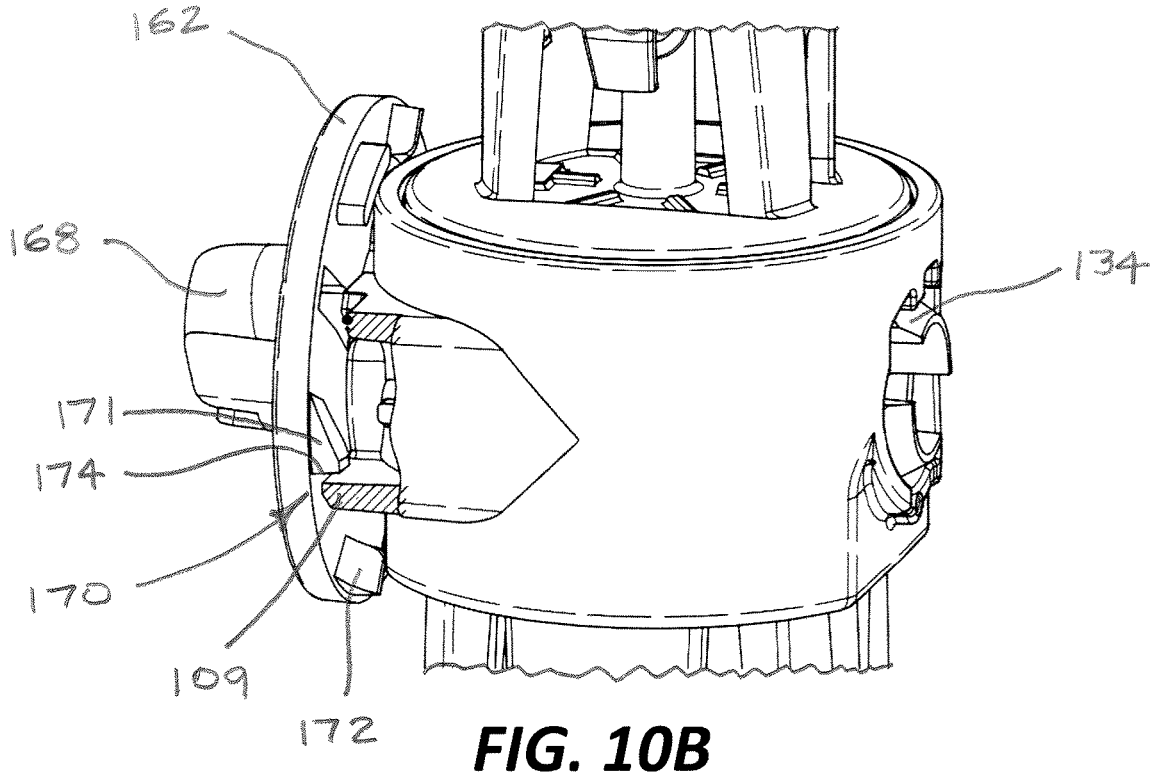
FIG. 10B is a truncated perspective view of the connector of FIG. 1, with the dial rotated to a second position.

Connector 100 has a one-way lock 170, which is shown engaged in FIG. 10B. The term "one-way lock", as used herein, refers to a mechanism that prevents relative movement of an object in one direction after the mechanism is engaged, but allows relative movement of the object in the opposite direction. In the present example, one-way lock 170 allows shaft 134 to rotate in the counterclockwise direction toward the second shaft position, but prevents the shaft from being rotated back toward the first shaft position after dial 162 is rotated counterclockwise past a certain point. This prevents connector 100 from being restored to the closed state after connector 100 is activated.

Figure 10C:
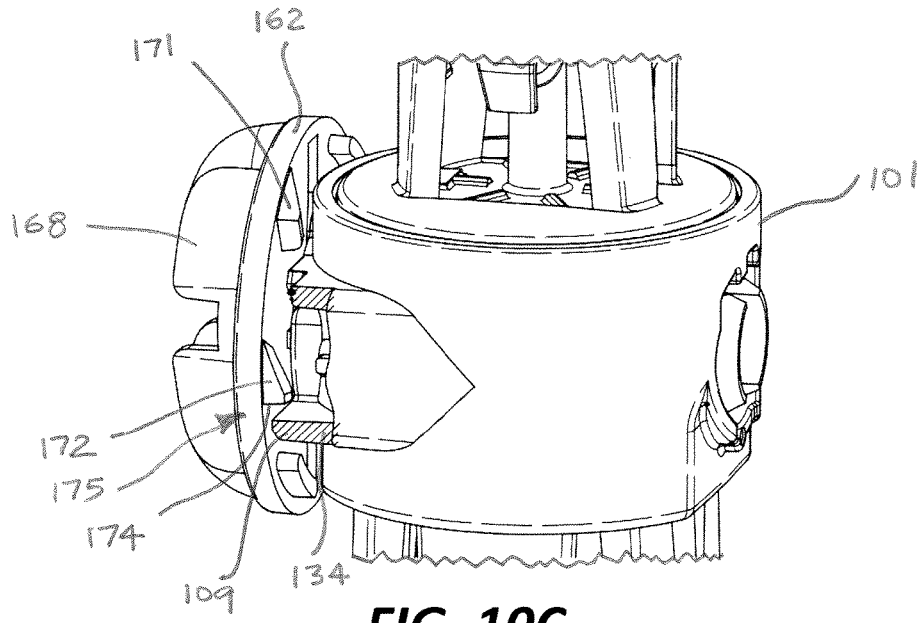
FIG. 10C is a truncated perspective view of the connector of FIG. 1, with the dial rotated to a third position.

One-way lock 170 cooperates with other features of connector 100 to eventually form a two-way lock 175. The term "two-way lock", as used herein, refers to a mechanism that prevents relative movement of an object in one direction after the mechanism is engaged, as well as relative movement of the object in the opposite direction. Two-way lock 175, which is shown engaged in FIGS. 3B and 10C, is configured to retain connector 100 in the activated state after activation to prevent the connector from being reused.

Referring to FIGS. 6 and 10A, one-way lock 170 includes two pairs of ratchet teeth or ramps arranged around second side 166 of dial 162. One-way lock 170 also includes two ledges 109 on the exterior of connector body 101 that engage the ramps. Each pair of ramps includes a first ramp 171 and a second ramp 172. First and second ramps 171, 172 project from second side 166 of dial 162 and are configured to engage ledges 109 on the exterior of connector body 101. One of the ledges 109 is shown in FIG. 10A. Each ledge 109 extends toward second side 166 of dial 162 in a position to positively engage first and second ramps 171, 172 when the dial is rotated. Each of ramps 171, 172 has a leading edge 173 and a trailing edge 174. Each leading edge 173 has a sloped surface, with the slope defined by an acute angle between the sloped surface and second side 166 of dial. Each trailing edge 174 extends normal to second side 166. First and second ramps 171, 172 are arranged on dial 162 so that their leading edges 173 are the first edges to engage ledge 109 during counterclockwise rotation.

Connectors according to the present disclosure can include removable caps that cover the first and second couplings. The removable caps can be configured to enclose the vial spike and cannula and protect them from contaminants. The removable caps can also allow users to hold the connector without placing their fingers near the vial spike and cannula, reducing the risk of injury from contact with the vial spike and cannula. Furthermore, the removable caps allow users to keep the vial spike and cannula covered, and delay exposing them until the moment before they are attached to drug vials and solution containers. Thus reduces the risk of the vial spike and cannula becoming contaminated before use.

Referring to FIG. 4, connector 100 includes a first cap 117 that is attachable over and removable from vial spike 112. Connector 100 also includes a second cap 119 that is attachable over and removable from second coupling 120. First and second caps 117, 119 can attach to vial spike 112 and second coupling 120, respectively, by any suitable mechanism, such as mating surfaces on the exterior of the connector and interior of the cap that releasably engage. Suitable examples include but are not limited to tabs, detents, threading and other connections.

Referring to FIG. 11A, connector 100 can be assembled in the following manner. Connector body 101 is made up of two separate halves, a first half 101*a* that includes first coupling 110, and a second half 101*b* that includes second coupling 120. First cap 117 is connected over vial spike 112 on first half 101*a*, and second cap 119 is connected over second coupling 120 on second half 101*b*. Seal body 140 is inserted into first half 101*a*, in an area that constitutes one part of chamber 103. The tapered shape of seal body 140 and wall 104 aid in properly orienting and seating the seal body into first half 101*a*. Once the seal body 140 is seated in first half 101*a*, second half 101*b* is connected to the first half over the seal body. This applies compression force around seal body 140.

Once connector body 101 is assembled, valve body 132 can be connected to the connector body. This is done by inserting second shaft end 134*b* of shaft 134 through openings 102 of connector body 101 and through cylindrical passage 142 of seal body 140. Inserting shaft 134 through connector body 101 after the first and second halves 101*a*, 101*b* are connected provides more flexibility and latitude to obtain the required forces and/or ultrasonic energy required to create a robust, functional and secure assembly.

Once shaft 134 advances through both sides of connector body 101, flanges 180 snap outwardly. Dial 162 and flanges 180 engage opposite sides of connector body 101 to lock the axial position of shaft 134 in the connector body. Insertion of shaft 134 through seal body 140 expands the seal body, thereby compressing the exterior of the seal body against walls 104 of chamber 103 to form a tight seal around the seal body.

Figure 14:
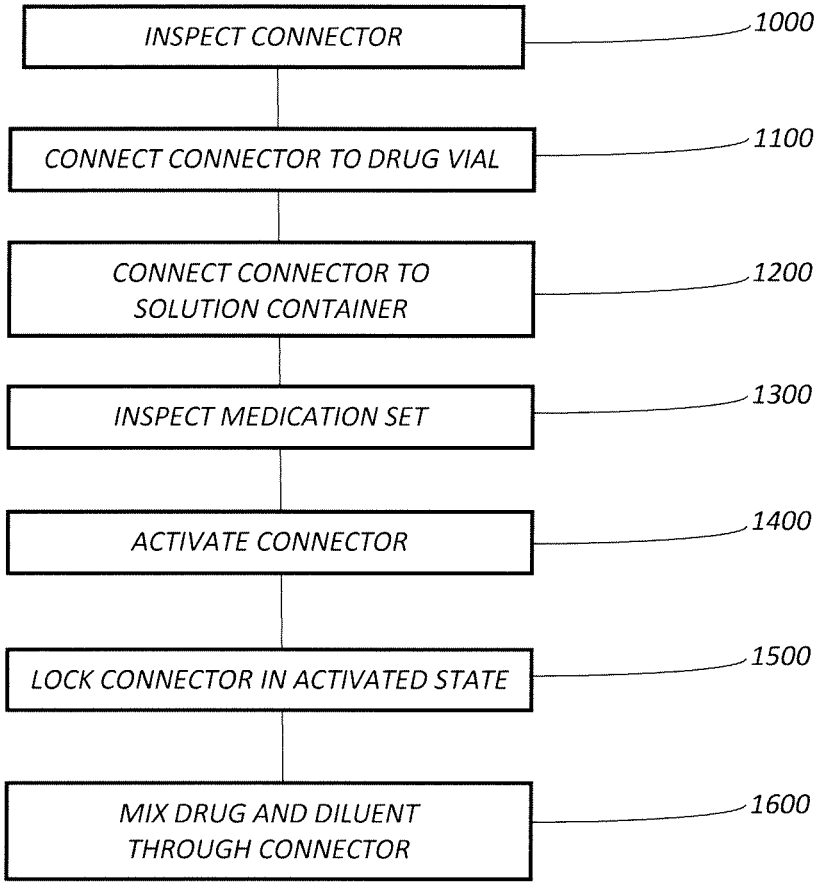
FIG. 14 is a diagram illustrating a method of operating the connector of FIG. 1 according to the present disclosure.

A method of using a connector according to the present disclosure will now be described with reference to steps illustrated in FIG. 14 and using connector 100 as an example.

Connector 100 is removed from any packaging and inspected prior to use (step 1000). In particular, connector should be inspected to confirm that the connector is in the closed state. If connector 100 is not in the closed state, the connector should not be used. The operative state of the connector is indicated by the relative orientation of dial 162. The relative orientation of dial 162 can be determined by observing the orientation of finger rest 168 relative to vial spike 112 and cannula 122. Finger rest 168 should be oriented horizontally when cannula 122 is pointed upwardly, as shown in FIG. 3A. In this position, shaft 134 is oriented in the first shaft position so that third fluid passage 131 is perpendicular to, and therefore out of fluid communication with, first and second flow passages 111, 121. This condition is shown in FIGS. 11A and 11B. First and second flow passages 111, 121 are sealed off from one another by seal body 140, preventing any transfer of fluid from solution container 60 to drug vial 50, and vice versa.

Once the closed state is confirmed, connector 100 is connected to drug vial 50 (step 1100). Drug vial 50 is prepared for use according to the manufacturer's instructions. For example, if drug vial 50 has a protective cap over the stopper, the cap can be removed and the stopper can be disinfected using institutional protocol. Drug vial 50 is then placed on a hard flat surface in an upright position with the stopper facing up.

First cap 117 is carefully removed from connector 100 to expose vial spike 112. Second cap 119 remains attached over cannula 122. Connector 100 is held above drug vial 50 with vial spike 112 facing downwardly and aligned with the drug vial's stopper. Connector 100 is then lowered over drug vial 50, with one hand holding the drug vial stable on the flat surface, and the other hand gripping second cap 119. Connector 100 is lowered until the top of drug vial 50 enters socket 118, and tip 115 contacts the stopper. Referring to FIG. 4, second cap 119 includes a cylindrical handle portion 119*a* with surface splines 119*b* that make the second cap easier to grip during this process. Second cap 119 also has a flat end 119*c* that provides a place for the user to rest their palm.

Using their palm, the user presses straight down on flat end 119*c* of second cap 119 to push connector 100 onto drug vial 50. Connector 100 is pressed down firmly until vial spike 112 penetrates through the stopper and tip 115 enters the inside of drug vial 50. At this stage, drug vial 50 is held firmly between tabs 113, with the tabs preventing lateral movement of the drug vial.

With drug vial 50 now attached, connector 100 is connected to solution container 60 (step 1200). Second cap 119 is removed from second coupling 120 to expose cannula 122. A large flange 119*d* is provided on second cap 119 that allows the user to apply twisting or pulling force to remove the second cap from second coupling 120. Solution container 60 can be prepared for connection to cannula 122 according to instructions provided by the container's manufacturer. For example, if solution container 60 has a protective cap over the port, the cap is removed. The port is then disinfected using the appropriate protocol.

Solution container 60 is grasped in one hand, and connector 100 is held in the other hand with second coupling 120 facing the port on the solution container. Connector 100 can be held by grasping connector body 101 and/or the bottom of drug vial 50, the latter of which is exposed outside of the connector as shown in FIG. 1. Connector 100 is then advanced toward solution container 60, or vice versa, until the port on the solution container begins to enter receiver 127. Connector 100 is also rotated until flanges 123 are oriented relative to solution container 60 so they can slide over the sides of the solution container. Once flanges 123 are properly oriented, connector 100 is pushed onto solution container 60 until tip 125 of cannula 122 penetrates the port and enters the interior of the solution container. Care should be taken not to squeeze or apply compression force to solution container 60 at any time during assembly.

Drug vial 50, solution container 60, and connector 100 are now attached to one another for form set 20. Set 20 can be stored according to institutional protocol in a ready-to-mix condition, with the contents of vial 50 and solution container 60 sealed from one another. Control valve 130 remains closed during storage and transport to keep diluent 61 from contacting drug 51, even if set 20 is subjected to compression, vibration, shock or other form of agitation.

When the medication is needed, set 20 can be removed from storage and inspected prior to use (step 1300). Connector 100 should be visually inspected to confirm that the connector has remained in the closed state during storage. As noted above, the operative state of the connector is confirmed by observing the orientation of dial 162 and finger rest 168, the latter of which should appear in the horizontal orientation shown in FIG. 3A.

In addition to inspecting connector 100, drug vial 50 and solution container 60 should be visually inspected to identify any evidence of leakage of drug 51 and/or diluent 61, and/or mixing of the drug with diluent. If there is any evidence of leakage or mixing, set 20 should be discarded. If no concerns are found, the medication can be prepared.

To mix the contents of drug vial 50 and solution container 60, the user activates connector 100 (step 1400). From the vantage point represented in FIG. 3A, connector 100 is activated by rotating dial 162 in the counterclockwise direction. Connector 100 has multiple features that indicate the correct direction of rotation in the event that the user forgets or is unsure of which direction to turn the dial. First, dial 162 includes visual indicia 167 on first side 164 of dial 162, as shown in FIG. 5. Indicia 167 consists of a written instruction and arrows indicating that the dial should be rotated counterclockwise to activate connector 100.

Connector 100 also provides tactile feedback that informs the user of the correct direction of rotation. Tactile feedback is provided by the initial engagement between tabs 161 and first end walls 106 in tracks 105. First end walls 106 abut tabs 161 to prevent the tabs from moving in a clockwise direction with respect to FIG. 3A. This creates physical resistance to clockwise rotation, which the user feels through their fingers when attempting to rotate dial 162 clockwise from the closed position.

As the user rotates dial 162 counterclockwise, tabs 161 begin moving in a counterclockwise direction along tracks 105. Shaft 134 also begins rotating counterclockwise relative to seal body 140. In particular, shaft 134 rotates out of the first shaft position and toward the second shaft position. This gradually rotates third fluid passage 131 into alignment with first and second fluid passages 111, 121. Dial 162 is rotated counterclockwise until first ramps 171 contact their corresponding ledges 109. As each first ramp 171 contacts its respective ledge 109, the user can detect a slight resistance to further rotation in their fingers. This resistance is caused by interference between ledges 109 and the sloped surfaces of leading edges 173. FIG. 10A shows dial 162 rotated counterclockwise with one of the ledges 109 interfering with one of the first ramps 171. The other first ramp 171 and ledge 109 are also engaged in the same manner on the opposite side of dial 162. In this state, dial 162 is deflected outwardly under stored energy in response to contact between first ramps 171 and ledges 109.

Figure 12A:
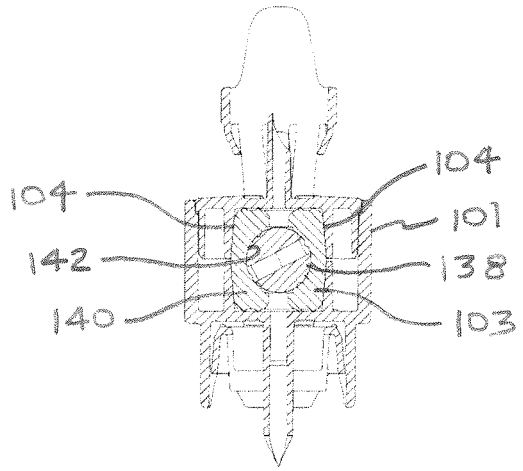
FIG. 12A is front cross sectional view of the connector of FIG. 1, with the valve body positioned in a second position.
Figure 12B:
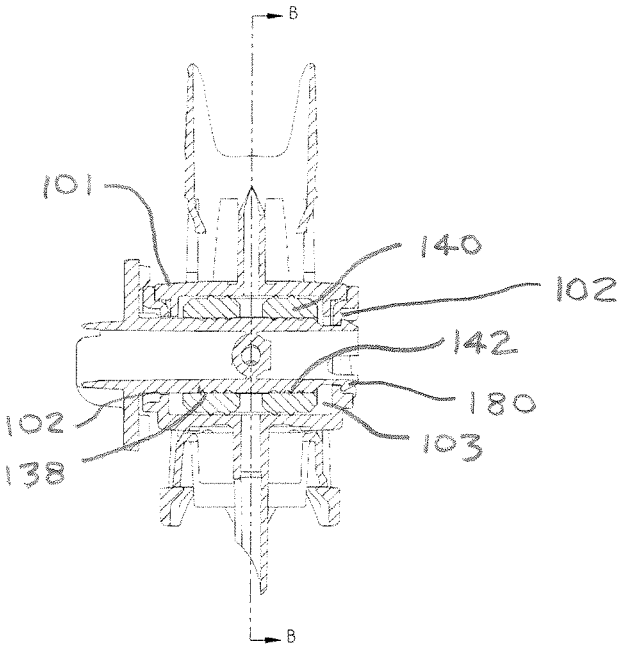
FIG. 12B is a side cross sectional view of the connector of FIG. 1, with the valve body positioned in the second position.
Figure 13A:
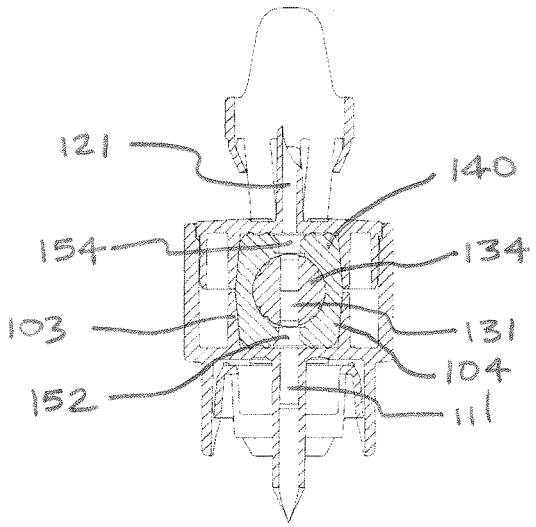
FIG. 13A is front cross sectional view of the connector of FIG. 1, with the valve body positioned in a third position.
Figure 13B:
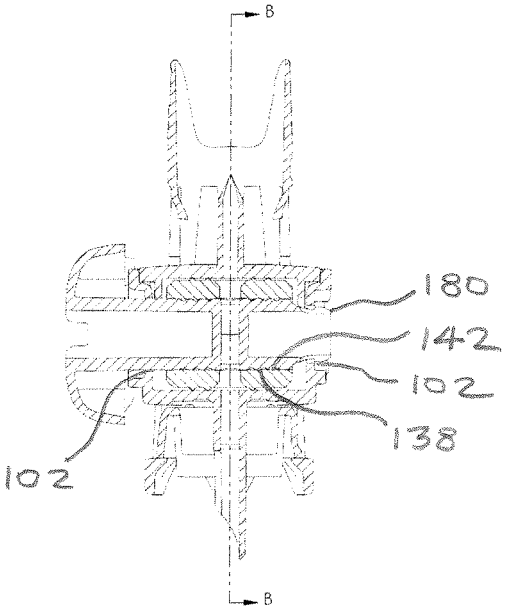
FIG. 13B is a side cross sectional view of the connector of FIG. 1, with the valve body positioned in the third position.

Dial 162 is rotated counterclockwise until the trailing edges 174 of first ramps 171 pass ledges 109. When the trailing edges 174 rotate past ledges 109, dial 162 reaches an intermediate position, indicating that connector 100 is partially activated. The term "partially activated", as used herein, refers to an operative state between the closed state and the activated state. First and second flow passages 111, 121 are still sealed from one another by seal body 140 to prevent transfer of fluid from drug vial 50 to solution container 60, and vice versa. However, third fluid passage 131 is rotated closer to alignment with first flow passage 111 and second flow passage 121. The partially activated state is shown in FIGS. 12A and 12B.

When dial 162 reaches the intermediate position, ledges 109 no longer interfere with first ramps 171. Therefore, the forces causing deflection of dial 162 are removed, allowing the stored energy in the dial to release and return the dial to its relaxed state. Dial 162 snaps back to its relaxed form, creating an audible click that the user hears. In addition, the user detects the disengagement of first ramps 171 from ledges 109 through tactile feel, as the resistance to counterclockwise rotation felt through finger rest 168 drops substantially. As such, the user feels greater and greater resistance to counterclockwise rotation as dial 162 approaches the intermediate position, followed by a sudden drop in resistance when the dial reaches the intermediate position. Finger rest 168 is oriented at an acute angle relative to its original horizontal orientation. This change in appearance of finger rest 168 allows the user to infer their progress as they rotate dial 162 toward the activated condition.

Each ledge 109 creates an obstruction in the path of each trailing edge 174 after dial 162 reaches the intermediate position. Each trailing edge 174 extends normal to second side 166, as noted above, such that it will abut its respective ledge 109 if the user attempts to rotate dial 162 clockwise from the intermediate position. As such, first ramps 171 and ledges 109 form a one-way lock 170, as mentioned earlier. One-way lock 170 prevents rotation of dial 162 clockwise from the intermediate position, while allowing continued counterclockwise rotation of the dial from the intermediate position. The abutment between one of the trailing edges 174 and its corresponding ledge 109 is shown in FIG. 10B.

Dial 162 is rotated counterclockwise from the intermediate position until second ramps 172 engage ledges 109. Second ramps 172 are configured to engage and pass ledges 109 in the same manner as first ramps 171. That is, dial 162 deflects to a stored energy condition and snaps back to a relaxed condition in the same or similar manner as when first ramps 171 engage and pass ledges 109. When the trailing edges 174 of second ramps 172 pass ledges 109, dial 162 has reached a final position, shown in FIG. 3B. In this state, shaft 134 is oriented in the second shaft position shown in FIGS. 13A and 13B, which places connector 100 in the activated state.

The activated state is signaled to the user in a manner similar to the partially activated state. Dial 162 snaps back to its relaxed form, creating an audible click that the user hears. In addition, the user can detect the disengagement of second ramps 171 from ledges 109 through tactile feel as dial 162 snaps back to its relaxed form. However, the user also notices that dial 162 has little or no ability to rotate in either the clockwise or counterclockwise direction relative to connector body 101. Clockwise rotation is limited by ledges 109, which obstruct the paths of second ramps 172 to limit or prevent clockwise rotation of dial 162. The obstruction created by one of the ledges 109 in the path of one of the second ramps 172 is shown in FIG. 10C.

Further rotation of dial 162 in the counterclockwise direction is also prevented by the abutment between tabs 161 and second end walls 107 of tracks 105. This abutment, shown in FIG. 3B, prevents shaft 134 from rotating past the second shaft position, which would rotate third flow passage 131 past its aligned orientation with first and second flow passages 111, 121. In this arrangement, second ramps 172, ledges 109, tabs 161 and second end walls 107 form the two-way lock 175 mentioned earlier. Two-way lock 175, which is represented in FIGS. 3B and 10C, prevents dial 162 from rotating in either direction after it reaches its final position. Therefore, rotation of dial 162 from the intermediate position to the final position passively locks connector 100 in the activated state (step 1500).

Once connector 100 is activated and locked in the activated state, the user can prepare the medication by mixing the contents of drug vial 50 and solution container 60 through the connector (step 1600). This may include steps such as folding and/or squeezing solution container 60 to cause diluent 61 to flow through connector 100 into drug vial 50 to mix with drug 51 and return to the solution container.

The foregoing steps do not apply exclusively to connector 100, and can be performed with other connectors according to the present disclosure.

Although this description makes reference to specific embodiments and illustrations, the present disclosure is not intended to be limited to the details shown. Rather, the present disclosure encompasses various modifications and combinations of embodiments and features described herein, as well as other variations that may be made within the scope and range of the claims and equivalents.

For example, in another exemplary embodiment, the connector could be activated by rotating the dial in a clockwise direction relative to FIG. 3A, rather than counterclockwise. In addition, the dial can feature more ramps on the dial to provide one-way locks at two or more intermediate positions. As an alternative, the dial can have only one ramp on each half of the dial, so that the dial is only lockable in the final position corresponding to the activated state. In such an arrangement, the dial would only be locked via a two-way lock.

Connectors according to the present disclosure can also connect containers at various angles other than the angle shown in FIGS. 1 and 2. For example, it may be desirable in some applications to connect a first fluid container with a second fluid container at a slight angle so that one of the containers is raised or tilted. In such an application, a connector may feature a first coupling and a second coupling angularly offset from the first coupling by an obtuse angle, for example 150 degrees, so that the second flow passage is offset from the first flow passage by 150 degrees. In another application, the connector can have first and second flow passages oriented in an L-shape, i.e. offset 90 degrees from one another. The third flow passage through seal body could be bent or curved at one or more sections to accommodate any angular offset between containers and any change in flow direction between the first and second flow passages.

Accordingly, it is intended that the appended claims cover all such variations as fall within the scope of the present disclosure.

What is claimed:

1. A connector for fluidly connecting a drug container with a solution container in a closed state, and for combining contents of the drug container and the solution container in an activated state, the connector comprising:

a connector body comprising:

a first coupling for fluid connection with the drug container, the first coupling defining a first fluid passage and having at least one aperture defined in a wall of the first coupling, the first coupling comprising a first chamber wall inside the first coupling; and a second coupling for fluid connection with the solution container, the second coupling defining a second fluid passage and a second chamber wall inside the second coupling, the second coupling directly connected to the first coupling such that the first chamber wall and the second chamber wall collectively form a chamber inside the first and second couplings;

a seal body housed inside the chamber, the seal body comprising a first portion housed inside the first chamber wall in the first coupling and a second portion housed inside the second chamber wall in the second coupling; and a control valve comprising a movable valve body defining a third fluid passage, the control valve extending through the at least one aperture and into the chamber, the valve body positionable relative to the connector body in a first position, in which the first fluid passage is sealed from the second fluid passage to place the connector in the closed state, and positionable relative to the connector body in a second position, in which the first fluid passage is connected in fluid communication with the second fluid passage by the third fluid passage to place the connector in the activated state.

2. The connector according to claim 1, wherein the first fluid passage extends parallel to the second fluid passage.

3. The connector according to claim 1, wherein the first coupling comprises a first piercing member having a first hollow body defining the first fluid passage.

4. The connector according to claim 1, wherein the second coupling comprises a second piercing member having a second hollow body defining the second fluid passage.

5. The connector according to claim 1, wherein the valve body comprises a shaft extending into the connector body, the shaft being rotatable relative to the connector body on a control axis.

6. The connector according to claim 5, wherein the third fluid passage extends through the shaft transversely to the control axis.

7. The connector according to claim 5, wherein the third fluid passage defines a first opening on a first side of the shaft and a second opening on a second side of the shaft.

8. The connector according to claim 7, wherein the first opening is diametrically opposite the second opening on the shaft.

9. The connector according to claim 5, wherein the shaft is cylindrical and comprises a cylindrical shaft surface.

10. The connector according to claim 8, wherein the seal body surrounds a cylindrical shaft surface.

11. The connector according to claim 10, wherein the seal body defines a seal body passage, the seal body passage having a passage wall that slidingly engages the cylindrical shaft surface.

12. The connector according to claim 11, wherein the seal body passage comprises a first passage end, a second passage end, and an inner diameter that varies between the first passage end and second passage end, so as to form one or more sections of reduced diameter configured to engage, wipe and form one or more seals with the cylindrical shaft surface.

13. The connector according to claim 11, wherein the passage wall comprises at least one annular seal that forms a seal interface between the seal body and the shaft.

14. The connector according to claim 13, wherein the seal body further defines a first aperture that forms a first conduit between the seal body passage and the first fluid passage, and a second aperture that forms a second conduit between the seal body passage and the second fluid passage.

15. The connector according to claim 14, wherein the first conduit and second conduit are axially aligned and located on opposite sides of the seal body passage.

16. The connector according to claim 14, wherein the third fluid passage is aligned with the first conduit and the second conduit when the connector is in the activated state.

17. The connector according to claim 14, wherein the third fluid passage is rotated out of alignment with at least one of the first conduit and the second conduit when the connector is in the closed state.

18. The connector according to claim 14, wherein the seal body further comprises an exterior surface, the exterior surface having at least one sealing rib around the first aperture and at least one sealing rib around the second aperture.

19. The connector according to claim 5, wherein the control valve further comprises a control handle attached to the shaft, the control handle rotatable relative to the connector body to rotate the shaft about the control axis.

20. The connector according to claim 19, wherein the control handle is rotatable between a first orientation in which the valve body is in the first position to place the connector in the closed state, and a second orientation in which the valve body is in the second position to place the connector in the activated state.

21. The connector according claim 20, wherein the control handle comprises a lock that prevents rotation of the valve body from the second position to the first position.

22. The connector according to claim 21, wherein the lock comprises a first locking element on the control handle and a second locking element on the connector body, the first locking element configured to engage the second locking element when the control handle is rotated to the second orientation.

23. The connector according to claim 22, wherein the first locking element comprises at least one ratchet tooth, and the second locking element comprises a ledge.

24. The connector according to claim 20, wherein the control handle comprises a first rotation limiter and the connector body comprises a second rotation limiter, the first rotation limiter configured to abut the second rotation limiter when the control handle is rotated to the second orientation to prevent the control handle from rotating past the second orientation.

25. The connector according claim 1, wherein the first coupling comprises a plurality of flexible tabs arranged in a circular arrangement around the first fluid passage, the plurality of flexible tabs defining a first socket sized to receive the drug container.

26. The connector according to claim 25, wherein the first coupling further comprises an adapter ring detachably connected to the first socket, the adapter ring sized to receive an alternate drug container having a different configuration than the drug container.

* * * * *